US007915579B2

(12) United States Patent
Chen et al.

(10) Patent No.: US 7,915,579 B2
(45) Date of Patent: Mar. 29, 2011

(54) METHOD AND APPARATUS OF LIQUID SAMPLE-DESORPTION ELECTROSPRAY IONIZATION-MASS SPECROMETRY (LS-DESI-MS)

(75) Inventors: Hao Chen, Athens, OH (US); Zhixin Miao, Athens, OH (US)

(73) Assignee: Ohio University, Athens, OH (US)

( * ) Notice: Subject to any disclaimer, the term of this patent is extended or adjusted under 35 U.S.C. 154(b) by 291 days.

(21) Appl. No.: 12/205,236

(22) Filed: Sep. 5, 2008

(65) Prior Publication Data

US 2010/0059674 A1 Mar. 11, 2010

(51) Int. Cl.
*H01J 27/00* (2006.01)
*H01J 49/10* (2006.01)

(52) U.S. Cl. ..... 250/288; 250/281; 250/282; 250/284

(58) Field of Classification Search ..... 250/281, 250/282, 288, 425
See application file for complete search history.

(56) References Cited

U.S. PATENT DOCUMENTS

| | | | | |
|---|---|---|---|---|
| 3,997,298 | A * | 12/1976 | McLafferty et al. | 422/70 |
| 4,861,988 | A * | 8/1989 | Henion et al. | 250/288 |
| 7,335,897 | B2 * | 2/2008 | Takats et al. | 250/425 |
| 7,525,105 | B2 * | 4/2009 | Kovtoun | 250/425 |
| 7,544,933 | B2 * | 6/2009 | Cooks et al. | 250/288 |
| 7,687,772 | B2 * | 3/2010 | Shiea | 250/288 |
| 7,714,281 | B2 * | 5/2010 | Musselman | 250/288 |
| 7,718,958 | B2 * | 5/2010 | Shiea et al. | 250/288 |
| 7,723,678 | B2 * | 5/2010 | Truche et al. | 250/288 |
| 7,750,291 | B2 * | 7/2010 | Shiea | 250/288 |
| 7,772,548 | B2 * | 8/2010 | Wollnik | 250/288 |
| 2006/0273254 | A1 * | 12/2006 | Berkout et al. | 250/288 |
| 2007/0221835 | A1 * | 9/2007 | Raftery et al. | 250/282 |
| 2008/0179511 | A1 * | 7/2008 | Chen et al. | 250/282 |
| 2008/0265152 | A1 * | 10/2008 | Bateman | 250/283 |
| 2009/0189069 | A1 * | 7/2009 | Chen et al. | 250/282 |
| 2009/0309020 | A1 * | 12/2009 | Cooks et al. | 250/282 |
| 2010/0044560 | A1 * | 2/2010 | Basile et al. | 250/282 |
| 2010/0059674 | A1 * | 3/2010 | Chen et al. | 250/288 |
| 2010/0078550 | A1 * | 4/2010 | Wiseman et al. | 250/282 |
| 2010/0140468 | A1 * | 6/2010 | Musselman | 250/282 |

OTHER PUBLICATIONS

ZJ Miao, H Chen, Analysis of Continuous-Flow Liquid Samples by Desorption Electrospray Ionization-Mass Spectrometry (DESI-MS), 56th Am. Soc. Mass Spectrom. Submitted Jan. 31, 2008.

Z Miao, H Chen, Direct Analysis of Continuous- Flow Liquid Samples by Desorption Electrospray Ionization-Mass Spectrometry (DESI-MS), Submitted Anal. Chem.

Z Takáts, JM Wiseman, B Gologan, RG Cooks, Electronsonic Spray Ionization. A Gentle Technique for Generating Folded Proteins and Protein Complexes in the Gas Phase and for Studying Ion-Molecule Reactions at Atmospheric Pressure, Anal. Chem. 76 (2004) 4050.

(Continued)

*Primary Examiner* — David A Vanore

(74) *Attorney, Agent, or Firm* — Wood, Herron & Evans, LLP

(57) ABSTRACT

An apparatus and method for direct analysis of continuous-flow liquid samples by desorption electrospray ionization-mass spectrometry (DESI-MS) including a sample stage that is adapted to receive a liquid sample and a nebulizing ionizer that is configured to generate a charged, nebulized solvent and thereby desorb at least a portion of the liquid sample from the sample stage.

24 Claims, 5 Drawing Sheets

OTHER PUBLICATIONS

CC Mulligan, DK MacMillan, RJ Noll, RG Cooks, Fast Analysis of High-Energy Compounds and Agricultural Chemicals in Water with Desorption Electrospray Ionization Mass Spectrometry, Rapid Comm. Mass Spectrom. 21 (2007) 3729.
H Chen, A Venter, RG Cooks, Extractive Electrospray Ionization for Direct Analysis of Undiluted Urine, Milk, and Other Complex Mixtures without Sample Preparation, Chem. Comm. (2006) 2042.
X Ma, M Zhao, Z Lin, S Zhang, C Yang, X Zhang, Versatile Platform Exmploying Desorption Electrospray Ionization Mass Spectrometry for High-Throughput Analysis, Anal. Chem. 80(15) (2008) 6131.
Zhixin Miao and Hao Chen, "Direct Analysis of Liquid Samples by Desorption Electrospray Ionization-Mass Spectrometry (DESI-MS)", /J. Am. Soc. Mass Spectrom/, 2008, Accepted on Sep. 24, 2008.

* cited by examiner

METHOD AND APPARATUS OF LIQUID SAMPLE-DESORPTION ELECTROSPRAY IONIZATION-MASS SPECROMETRY (LS-DESI-MS)

FIELD OF THE INVENTION

The present invention is related to methods of sample ionization for mass spectrometry. More specifically, the invention relates to the ionization of samples under ambient environmental conditions.

BACKGROUND

Ambient mass spectroscopy is a recent advancement in the field of analytical chemistry and has allowed for the analysis of samples with little-to-no sample preparation. Based on this concept, a variety of ambient ionization methods have been introduced, including desorption electrospray ionization (DESI), direct analysis in real time (DART), desorption atmospheric pressure chemical ionization (DAPCI), electrospray-assisted laser desertion/ionization (ELDI), matrix-assisted laser desorption electrospray ionization (MALDESI), extractive electrospray ionization (EESI), atmospheric solids analysis probe (ASAP), jet desorption ionization (JeDI) desorption sonic spray ionization (DeSSI), desorption atmospheric pressure photoionization (DAPPI), plasma-assisted desorption ionization (PADI), and dielectric barrier discharge ionization (DBDI).

DESI is a representative method for ambient mass spectrometry. It has been shown to be useful in providing a rapid and efficient means of desorbing, or ionizing, a variety of target compounds of interest under ambient conditions. For example, analytes such as pharmaceuticals, metabolites, drugs of abuse, explosives, chemical warfare agents, and biological tissues have all been studied with these ambient ionization methods.

However, DESI analysis has been restricted to solid samples. To analyze a fluid sample, the solution needed to be dried in air. Alternatively, the solution was passed through filter paper or a membrane (collectively "filters"), which captures the analyte, separating it from the solvent. This use of filters or drying sample in air was necessary because the high-velocity nebulizing gas used in direct analysis would blow away the liquid sample from the sample surface and result in a short-lived ion signal. However, these protocols increases the time, complexity, and/or cost for liquid sample analysis and may change the surrounding environment of analytes prior to analysis.

Ambient ionization sampling of solids, or liquid samples via filters, by DESI tended to have limited ability to desorb and ionize molecules greater than approximately 25 kDa in molecular weight. This was presumably due to the formation of molecular aggregates by intermolecular interactions within the closely-packed solid sample.

One potential method for direct analysis of liquid samples is extractive electrospray ionization (ESSI). ESSI requires two separate nebulizing sprayers: one to nebulize the sample solution and the other to nebulize the ionizing solvent solution. This method is dependent upon liquid-liquid extraction and the collision of microdroplets. Thus, several parameters must be controlled to extract the best possible ion signal for each target sample. This leads to greater complexity of both the method and device. Other existing methods for liquid sample analysis using mass spectrometry include electrospray-assisted laser desertion/ionization (ELDI) and field induced droplet ionization (FIDI). However, these methods require either laser or high electric fields to assist sample desorption thus increasing the protocol complexity.

Thus, there remains a need to easily analyze a range of target samples of interest using a simple device, including those of high molecular weights within a liquid matrix environment at ambient conditions. Therefore, it would be beneficial to develop an ambient ionization method, like DESI, for use with liquid samples. Such a method would be particularly useful in bioanalytical, forensic, pharmaceutical, and border security applications where direct and efficient analysis of liquids is needed.

SUMMARY OF THE INVENTION

According to the present invention, a liquid is ionized for analysis by a mass spectrometer by contacting the liquid sample with charged solvent microdroplets, which desorb and ionize the liquid sample, or analyte. The ionized analyte can then be directed through a mass spectrometer for detection.

The present invention further relates to an ionization apparatus, for the analysis of liquid samples. The apparatus includes a sample stage that is adapted to receive a liquid sample and a nebulizing ionizer that is configured to generate a charged and nebulized solvent microdroplets and thereby desorb at least a portion of the liquid sample from the sample stage.

The objects and advantages of the present invention will be further appreciated in light of the following detailed description and drawings provided herein.

BRIEF DESCRIPTION OF THE FIGURES

The accompanying drawings, which are incorporated in and constitute a part of this specification, illustrate embodiments of the invention and, together with a general description of the invention given above and the detailed description given below, serve to explain the principles of the invention.

DETAILED DESCRIPTION

Figure 1:
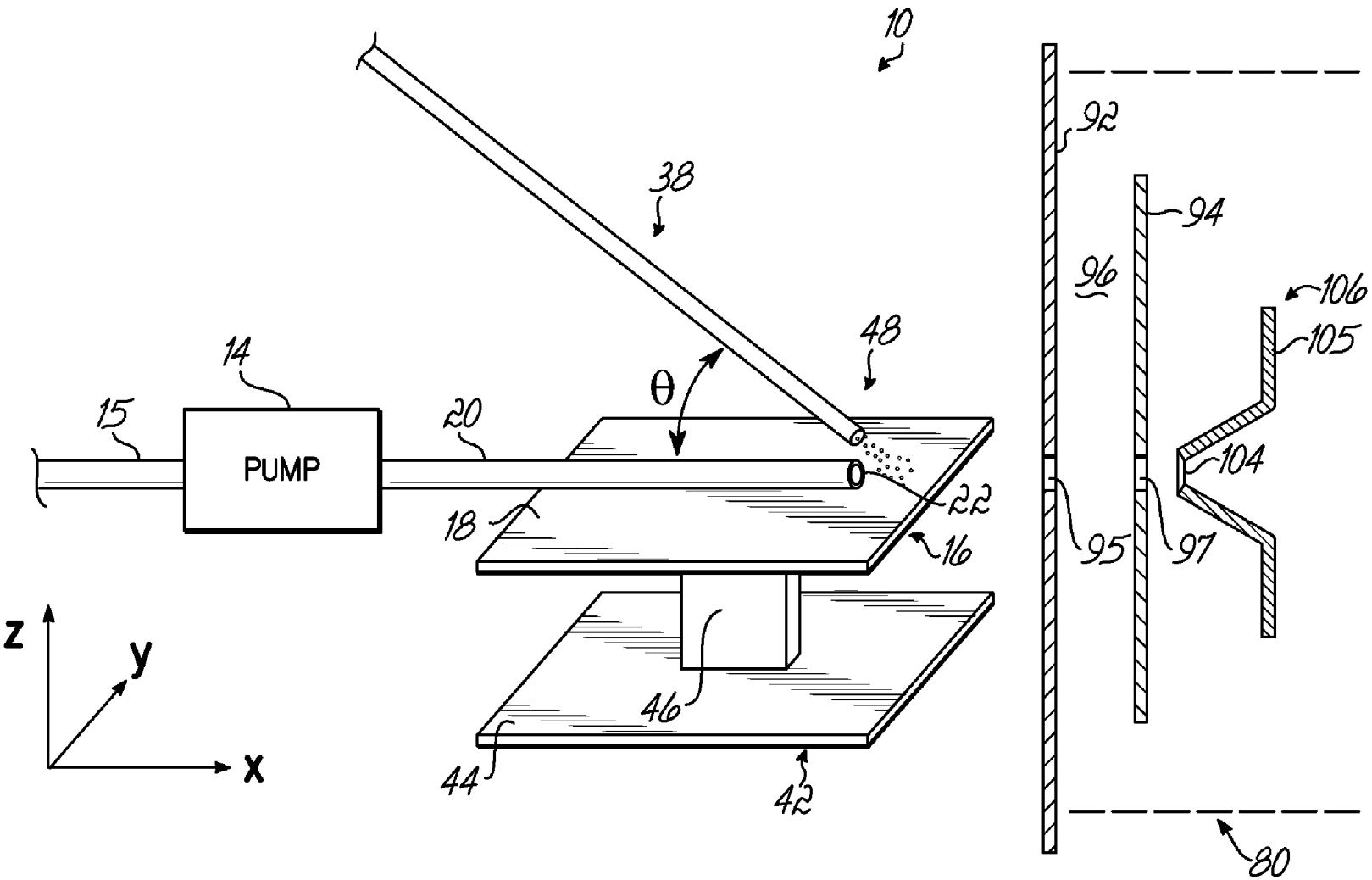
FIG. 1 is a diagrammatic view of an ionization apparatus according to one embodiment of the present invention, with a mass spectrometer shown in cross-section.

According to the present invention, an analyte from a liquid sample is ionized by desorption of the analytes with an ionization apparatus 10, which generates microdroplets 48 of a charged and nebulized solvent under ambient conditions. This generator in turn forms an ionized sample, which can be analyzed by mass spectrometry.

Operation of the ionizing apparatus 10 begins with the preparation of a liquid sample 12. The liquid sample 12 can be a known entity for generating a calibration curve or an unknown entity for identification. Liquid samples 12 can be prepared by dissolving a solid sample in a nonpolar or polar solvent, such as a 1:1 ratio of water and methanol or a 1:1:0.005 ratio of water, methanol, and acetic acid. Otherwise, liquid samples 12 will generally require little-to-no additional preparation and can include, for example, protein digests or biological fluids.

The liquid sample 12 is then pumped via a pump 14, such as a continuous-flow or syringe pump, onto a surface 18 of a sample stage 16 through a fluid connector 15. A suitable continuous-flow pump 14 can be a Chemyx Model F100 syringe pump (Houston, Tex.), which is connected to a tube, such as a tubing, a syringe, or a capillary 20, and moves the liquid sample at flow rates from approximately 0.1 μL/min to approximately 5 μL/min. Other flow pumps and flow rates could also be used.

The liquid sample 12 moves continuously by the continuous-flow pump 14 to a capillary 20. The capillary 20 includes a distally located opening 22, which is positioned on the sample stage 16. Though not specifically shown, the capillary 20 can be affixed to the surface 18 of the sample stage 16, such as by a clamp, which will prevent movement of the opening 22. The capillary 20 can be constructed from a non-reactive material, such as silica, stainless steel, or aluminum, and can have an inner diameter of approximately 0.1 mm. However, the capillary 20 should not be considered so limited.

The sample stage 16 is simply a planar surface. It can be constructed from any nonreactive material, such as polytetrafluoroethylene. The design of the sample stage 16 can vary, but should be suitable to accommodate the capillary 20 and a nebulizing ionizer 38 such that at least a portion of the liquid sample 12 can be desorbed and directed substantially toward a mass analyzer 40 according to methods discussed in detail below. The sample stage 16 can be removably attached to a support structure 42, which can include a base 44 and a podium 46. Suitable materials for the support structure 42 can include non-reactive metals, such as aluminum. This support structure 42 can further include the operational mechanics (not shown) within the podium 46 such as those for incorporating a moveable sample stage.

The continuous-flow pump 14 supplies the liquid sample 12 to the sample stage 16 at a rate of approximately 0.1 μL/min to approximately 10 μL/min. At these rates an adequate supply of the liquid sample 12 is available on the sample stage 16 for analysis but without excess puddling, which can result in splashing and a short-lived ion signal.

Figure 3:
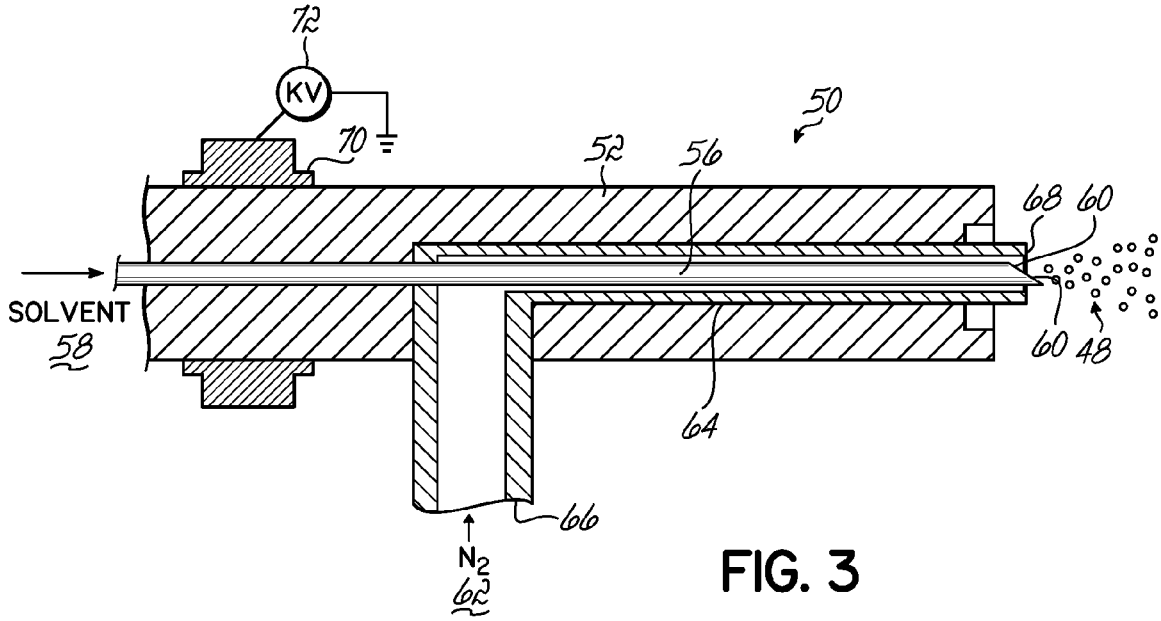
FIG. 3 is a diagrammatic cross-sectional view of a nebulizing ionizer for generating a charged and nebulized solvent according to the present invention.
Figure 4:
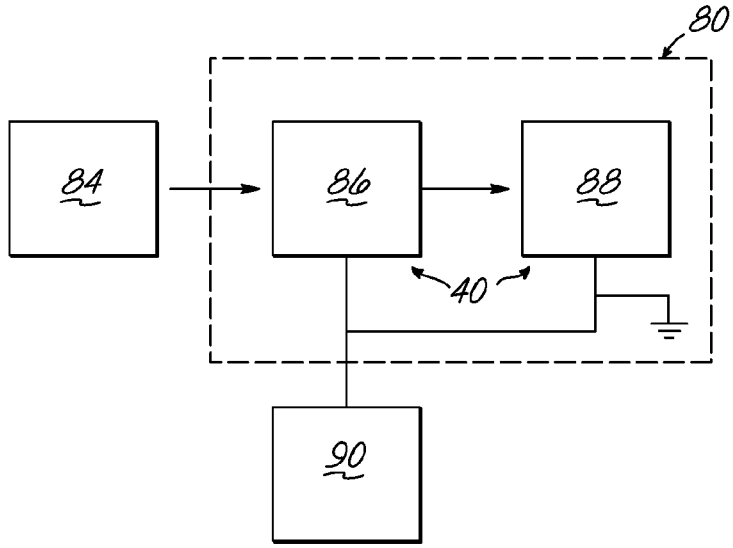
FIG. 4 is a schematic representation of the components of a conventional mass-spectrometer.

Once the liquid sample 12 is supplied to the sample stage 16, at least a portion of the liquid sample 12 is desorbed by microdroplets 48 of a charged and nebulized solvent discharged from a nebulizing ionizer 38. The nebulizing ionizer 38 can be an ESSI apparatus 50, as illustrated in FIG. 3. The ESSI apparatus 50 includes a housing 52, a solvent conduit 56 having a solvent inlet 58 and a solvent outlet 60, which is surrounded by a gas conduit 64, or tube, having a gas inlet 66 and a gas outlet 68. The gas outlet 68 is typically positioned 0.1 mm to 0.2 mm proximally to the solvent outlet 60.

The solvent conduit 56 of the ESSI apparatus 50 can be a fused silica capillary having a tapered tip 57 at the solvent outlet 60 and an inner diameter ranging from approximately 5 μm to approximately 100 μm. The gas conduit 64 can also be a fused silica capillary, but will have an inner diameter larger than the solvent path 56 diameter, i.e. typically about 0.25 mm; however, these dimensions should not be considered limiting.

A voltage generator 70 with a voltage supply 72 is attached to the housing 52 as shown and is operable to charge the solvent 58 within the solvent conduit 56.

In operation, the solvent 58 is supplied to the inlet 58 of the solvent conduit 56 at a rate of approximately 0.05 μL/min to approximately 50 μL/min. While the particular solvent used is dependent on the liquid sample 12 in study, one example of an appropriate solvent mixture can be methanol and water with either 0.5% or 1% acetic acid, v/v, which is injected at a rate of approximately 10 μL/min. The gas 62, typically an inert gas such as $N_2$, is supplied to the inlet 66 of the gas conduit 64 at pressures ranging from approximately 8 bar to approximately 25 bar. An electric potential, typically ranging from 4 kV to approximately 5 kV (4.5 V to 5.5 V for positive ion mode), is applied to the solvent 58 through the housing 52 via the voltage generator 70. This generates an electrically charged solvent 54 within the solvent conduit 56.

The now electrically charged solvent 54 traverses the solvent conduit 56 to the outlet 60. At the outlet 60, the charged solvent 54 is impacted by the surrounding high-pressure gas 62 leaving the outlet 68 of the gas conduit 64. This high-pressure gas 62 causes the flow of the charged solvent 54 to be nebulized into microdroplets 48 of charged and nebulized solvent.

Figure 5:
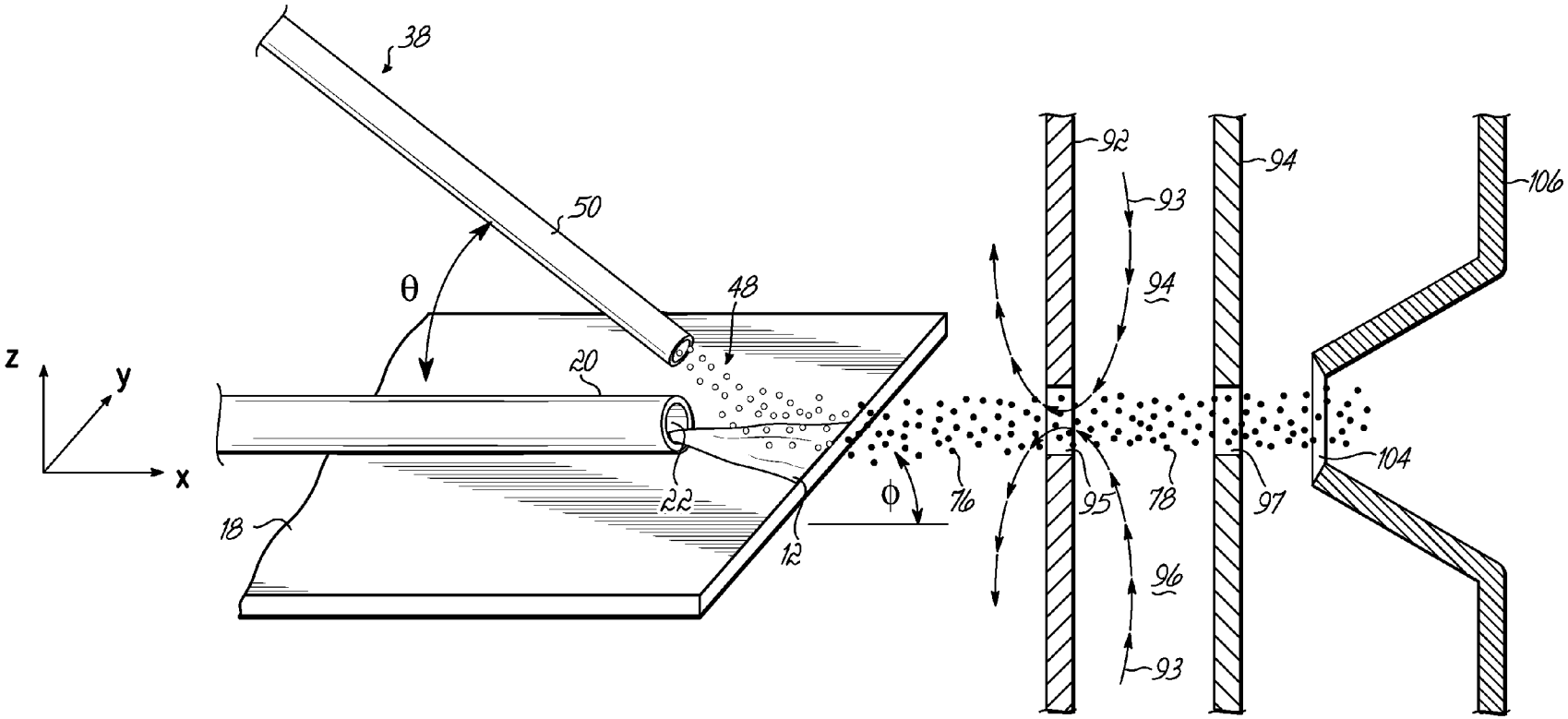
FIG. 5 is a diagrammatic view of the desorption of the analyte from the liquid sample by an ionization apparatus according to one embodiment of the present invention into the cavity of the mass-spectrometer with a curtain gas interface, shown in cross-section.

The ESSI apparatus 50 is positioned at a spray impact angle, θ, with respect to an x-y plane defined by the surface 18 of the sample stage 16. This θ will cause the desorption and deflection of the analyte 74 into the mass analyzer 40, as shown in FIG. 5. While θ can range from approximately 30° to approximately 45°, an appropriate value of θ will increase the likelihood of desorbed analyte 74 entering the mass analyzer 40. As shown in FIG. 5, the spray impact angle θ will cause analyte to be desorbed from the surface 18 of the sample stage 16 at a deflection angle, ϕ. This deflection angle, ϕ, depends upon the molecular weight of the desorbed analyte 74, the momentum of the microdroplets 48 of the charged and nebulizing solvent, and θ. Thus, an optimal impact angle θ will exist for each liquid sample 12 that will maximize the amount of desorbed analyte 74 entering the mass analyzer 40 and thus increase the ion signal response.

While not wishing to be bound by theory, it is believed that the mechanism by which the microdroplets 48 of the charged and nebulizing solvent interact with the liquid sample 12 and desorbs at least a portion of the liquid sample 12 is chemical sputtering, charge transfer, or droplet pick-up, with the most likely mechanism being droplet pick-up. During droplet pick-up, the microdroplets 48 of the charged and nebulizing solvent interact with the liquid sample 12 to yield desorbed secondary charged droplets 76 of analyte. The secondary charged droplets 76 then undergo desolvation to yield ions of the analyte 78. Desolvation can occur within the cavity 80 of the mass analyzer 40 and is discussed in greater detail below.

The ionizing apparatus 10 can be used with any one of several mass spectrometry instruments. The ionizing apparatus 10 of the present invention is then interfaced to a cavity 80 of a mass spectrometer 82 containing a mass filter 86 and the mass detector 88, which are maintained at vacuum. This interface typically will also evaporate and remove the solvent from the secondary charged droplet 76.

As shown, the cavity 80 includes a first plate 92, which is positioned at the opening to the cavity 80, and a second plate 94, which defines a space 96 through which a counter-flow curtain gas is supplied, as indicated by arrows 93. Plates 92 and 94 include aligned orifices 95, 97, respectively, providing inlets for the secondary charged droplets 76 of analyte to enter the mass spectrometer 82. The curtain gas can be any inert gas, but is typically dry $N_2$ at slightly above atmospheric pressures.

In operation, the curtain gas flows out of the orifice 95 of the first plate 92 and across the secondary charged droplets 76 of analyte causing remaining solvent to be evaporated from the secondary charged droplet 76. In some instances, a positive voltage potential (ranging from approximately 5 V to approximately 80 V) can be applied to the second plate 94 by a voltage source (not shown). The positive voltage potential will electrostatically decluster the secondary charged droplets 76.

Because the curtain gas exits through the orifice 95 of the first plate 92, it is possible that the curtain gas may influence the desorption of the secondary charged droplet 76. Thus, it may be necessary to position the ESSI apparatus 50 approximately 0.5 mm behind the opening 22 of the capillary 20 to overcome this influence.

After the desolvation of the secondary charged droplet 76, the now ions of analyte 78 enter the mass analyzer 40 through an orifice 94 of the second plate 94, which provides an opening into the mass analyzer 40 of the mass spectrometer 82 while maintaining a vacuum within the mass analyzer 40. Once the ions of analyte 78 are within the mass analyzer 40, the ions of analyte 78 are directed to a skimmer 106 before entering the mass filter 86. The second plate 94 encloses the mass analyzer 40 and is connected to a vacuum pump (not shown), which creates the vacuum. A skimmer 106 includes a plate 105 and an orifice 104, which is usually cone-shaped. The skimmer 106 is operable to focus the ions of analyte 78 into a narrow beam (not shown) of ion current as it enters the mass analyzer 40. This skimmer is typically grounded. Additionally, a separate focusing lens (not shown) can be included between the skimmer 106 and the mass filter 86 to further focus the beam containing the ions of analyte 78 and reduce the natural expansion of the beam by effusion through the orifice 104 of the skimmer 106.

After passing the skimmer 106, the ions of analyte 78 are directed to the mass filter 86. Conventional mass filters include time-of-flight, quadrupolar, sector, or ion trap, which are operable to cause ions of analyte 78 having a specified mass-to-charge (m/z) ratio to transverse the mass filter 86 and be quantified at the mass detector 88. Those ions of analyte 78 having a m/z value that differs from a specified m/z value will impact the mass filter 86. One particularly suitable instrument is the hybrid triple-quadrupole-linear ion trap mass spectrometer, Q-trap 2000, by Applied Biosystems/MDS Sciex (Concord, Canada).

In operation of a conventional quadrupole modality of a mass spectrometer 82, the ions of analyte 78 are directed through four parallel electrodes, wherein the four parallel electrodes are comprised of two pairs of electrodes. A radiofrequency field and a DC voltage potential are applied to each of the two pairs of electrodes by a power supply such that the two pairs differ in polarity of the voltage potentials. In operation, only the ions of analyte 78 having a particular m/z will continue through the parallel electrodes to the mass detector 88. That is, the ion of analyte 78 with the particular m/z will be equally attracted to and deflected by the two pairs of electrodes while the mean free path induced by the radiofrequency field onto the ion of analyte 78 does not exceed distance between the electrode. Thus, the ion of analyte 78 having the particular m/z will balance the radiofrequency and DC voltage forces from the parallel electrodes, and will thereby traverse the parallel electrodes and impact the mass detector 88.

Those ions of analyte 78 that reach the mass detector 88, typically a Faraday plate coupled to a picoammeter, are measured as a current (l) induced by a total number (n) of ions of analyte 78 impacting the mass detector 88 over a period of time (t) and in accordance with n/t=l/e, wherein e is the elementary charge.

The controller 90 operates the four parallel electrodes and the mass detector 88 such that the current measured at the mass detector 88 can be correlated to the radiofrequency field and the DC voltage potential applied to the four parallel electrodes. A suitable controller 90 can be a standard PC computer; however, the present invention should not be considered so limited. The controller 90 may further include a memory for storing data related to operation of the mass spectrometer 82 for later chemical analysis. The memory can be internal, such as a hard-drive ROM, or a removable ROM for off-site, off-line chemical analysis. Additionally, the controller 90 can include a data transmission means for sending the stored data to another suitable workstation. Said data transmission means can be a wireless device or hard-wired.

Typically, the controller 90 will further include a chemical analysis software for on-site and immediate analysis of a liquid sample 12. This chemical analysis software is operable to generate a calibration curve, generated in a known manner with liquid samples 12 containing known chemical analytes, and is operable to extrapolate the m/z value for an unknown chemical analyte based upon the calibration and in a known manner.

While the ionization apparatus 10 and method of using the ionization apparatus 10 have been provided in some detail above, various other embodiments of the present invention are envisioned and will now be explained.

In one embodiment, this LS-DESI-MS can be coupled to conventional separation techniques, such as HPLC, electrophoresis, or microfluidics. In this regard, the liquid sample 12 is prepared according to the particular needs of the separation techniques. The liquid sample 12 flowing out of the separation device will be loaded into the LS-DESI-MS. Because of the flexible nature of the ionizing apparatus 10 of the present invention, and the reduced affects thereon by the liquid matrix, the liquid sample 12 can be prepared with a high salt matrix, surfactants, or other solvents and solutes not traditionally used with mass spectroscopy analysis.

In another embodiment, the LS-DESI-MS apparatus can be used for remote detection of dangerous liquid substances, such as explosives and chemical/biological warfare agents. The dangerous liquid, located in a remote site, can be introduced by a peristaltic pump and an extended tube into the LS-DESI-MS apparatus. In this way, only a small aliquot of the dangerous liquid will be introduced to the proximately-located detection device, i.e. the mass analyzer. This embodiment can be useful in providing personnel safety in airports and the battle fields while a potentially dangerous liquid substance is analyzed.

In yet other embodiments, a reactant can be added to the solvent 58 of the DESI apparatus 50. This is particularly applicable in instances wherein an ionic or molecular reaction is required during the sampling process or to enhance the selectivity of the chemical analysis. For example, zinc complexes ($Zn^2$+) have been shown to aid in the ionization of phosphate-containing compounds. For example, $[Zn(DPA)]^{2+}$ is a known phosphate binding motif. In this way, an aqueous solution of $Zn(NO_3)_2$ and 2,2'-dipicolylamine (DPE) can be added to the solvent 58 entering the solvent conduit 56 of the DESI apparatus 50. Thus, the microdroplets 48 of the charged and nebulized solvent will include the $[Zn(DPA)]^{2+}$ complex, which can then react with an analyte of the sample.

The product of the $[Zn(DPA)]^{2+}$ and analyte reaction can then be desorbed in a manner described above.

Alternatively, the selective nature of zinc complex chemistry can lead to selective ionization. That is, the zinc complex can be selected based upon its selective reactivity with a first analyte over a second analyte, wherein the first and second analytes are in the liquid sample 12. In this way, the first analyte will react with the zinc complex and can then be desorbed while the second analyte remains in the liquid sample 12.

Figure 2A:
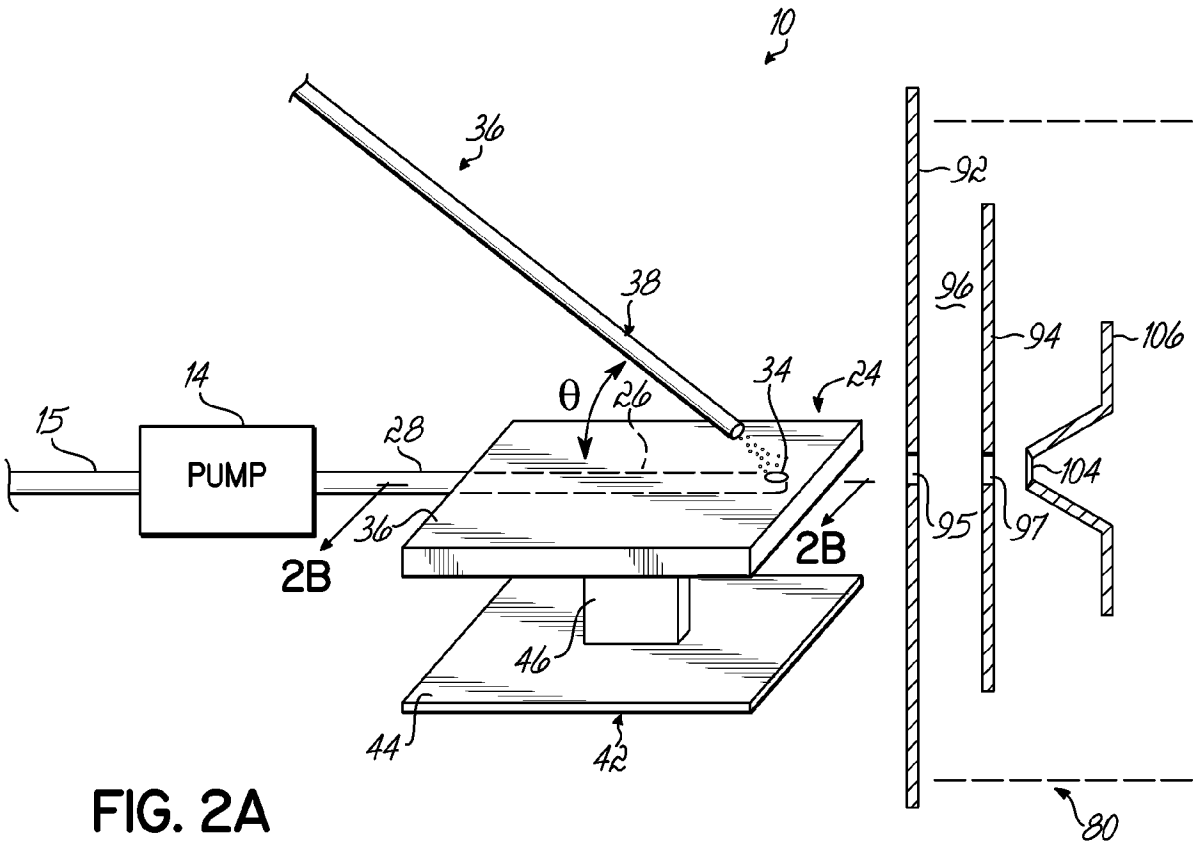
FIG. 2A is a diagrammatic view of an alternate embodiment of an ionization apparatus according to the present invention, with a mass spectrometer shown in cross-section.
Figure 2B:
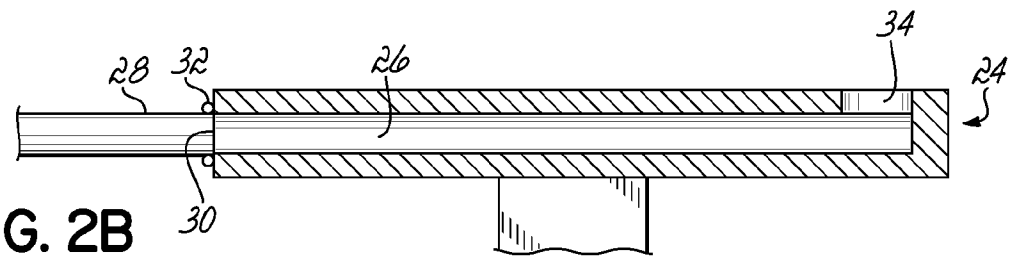
FIG. 2B is a diagrammatic cross-sectional view of the sample stage of the ionization apparatus of FIG. 2A.

In yet other embodiments, the ionizing apparatus 10 includes a modified sample stage 24 having a microfluid channel 26 as shown in FIG. 2A. In this way, the continuous-flow pump 14 delivers the liquid sample 12 to a capillary 28, which terminates at an inlet 30 of the microfluid channel 26. The inlet 30 can further include a sealant, such as an O-ring 32, for providing a fluid-tight seal between the capillary 28 and the microfluid channel 26 (see FIG. 2B). The liquid sample 12 will traverse the microfluid channel 26 and exit the microfluid channel 26 at an outlet 34 upon the surface 36 of the sample stage 24. The microfluid channel 26, which can be formed during the sample stage 24 molding process or created thereinafter by drilling or similar method and will be substantially similar in size as compared to the capillary 20. Other arrangements for delivery of the liquid sample 12 would be appropriate and may depend on the nature of the analyte or the liquid matrix.

Figure 6:
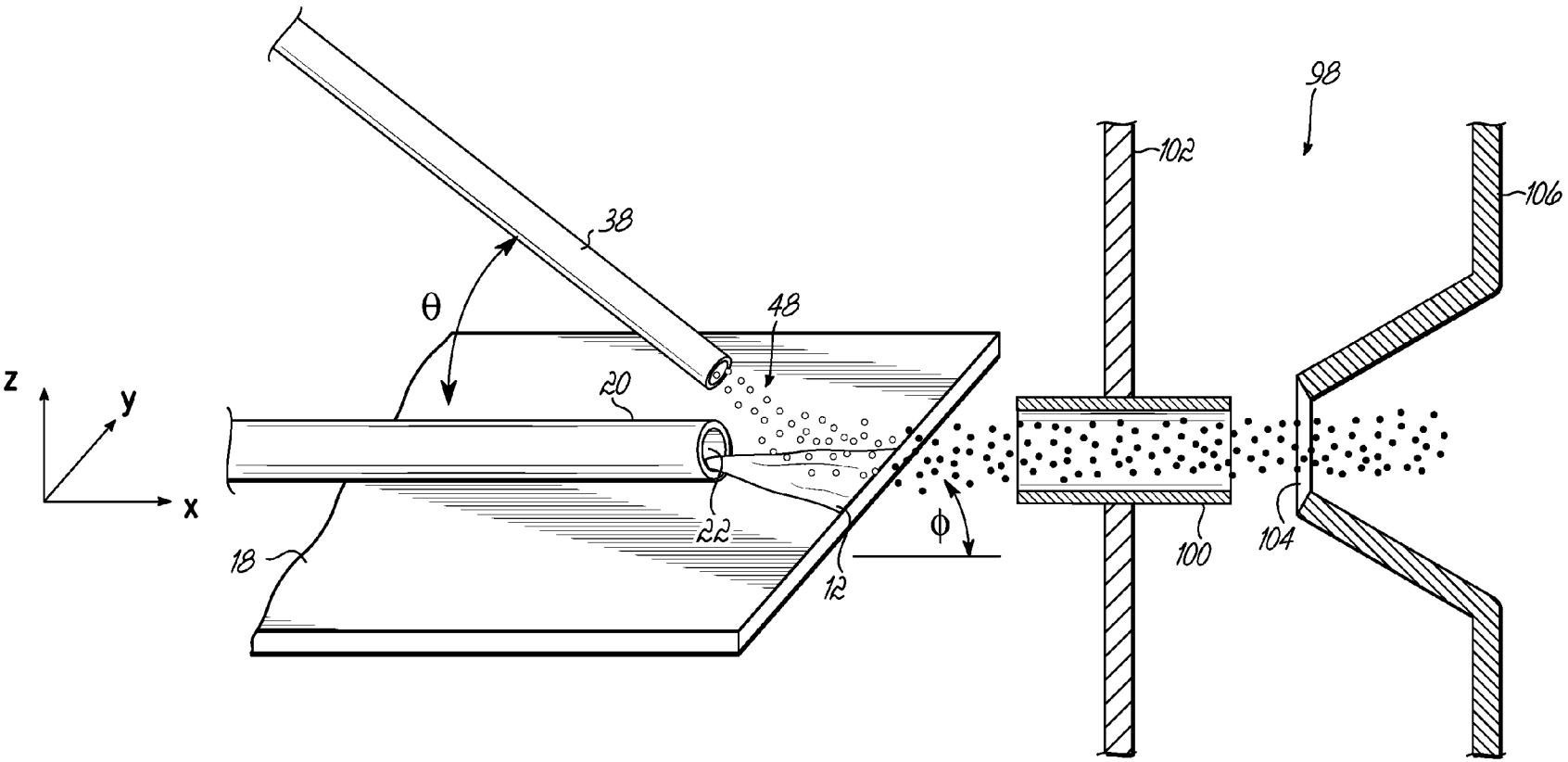
FIG. 6 is a diagrammatic view of the desorption of the analyte from the liquid sample by an ionization apparatus according to one embodiment of the present invention into the cavity of the mass-spectrometer with a heated capillary interface, shown in cross-section.

In yet another embodiment, as shown in FIG. 6, the plates 92 and 94 and the gas 93 can be eliminated by interfacing the ionizing apparatus 10 with the cavity 80, which includes a heated capillary interface 98. This interface 98 includes a capillary 100 positioned in a wall 102 of the cavity 80, wherein the capillary 100 is aligned with the orifice 104 of the skimmer 106. The capillary 100 can be constructed of metal or glass, which is resistively heated to a range from about 100° C. to about 200° C. by an energy source (not shown). As the secondary charged droplets 76 are desorbed toward, and then enter, the capillary 100, the secondary charged droplets 76 are heated and any remaining solvent within the secondary charged droplet 76 is evaporated. An energy source (not shown) can apply a positive voltage potential to the capillary 100, which will decluster the secondary charged droplets 76.

In yet another embodiment, the ionizing apparatus 10 may be enclosed within a chamber (not shown) and operate under a carrier gas environment, such as nitrogen. While it is not necessary for the carrier gas to alter the local pressures significantly from ambient conditions, the $N_2$ environment can decrease the likelihood of an undesired reaction occurring between the liquid sample 12 and a component within the air.

As provided for herein, the ionizing apparatus 10 of the present invention can operate under ambient conditions while ionizing analytes of interest from a liquid sample 12 and without the use of filters or by air drying the samples. The ionizing apparatus 10 is capable of desorbing various analytes of interest, including those with high molecular weights (above 60 kDa), from the liquid sample, does not require additional sample preparation, and operates with minimal adjustment by the user.

This has been a description of the present invention along with the various methods of practicing the present invention. However, the invention itself should only be defined by the appended claims.

What is claimed is:

1. A liquid sample ionizer comprising:

a fluid conduit configured to continuously supply a liquid sample;

a sample stage configured to receive the liquid sample from the fluid conduit; and a nebulizing ionizer configured to generate a charged, nebulized solvent and to direct the charged, nebulized solvent onto the liquid sample on the sample stage, wherein the charged, nebulized solvent desorbs at least a portion of the liquid sample from the sample stage.

2. The liquid sample ionizer of claim 1, wherein the nebulizing ionizer includes a source of charged solvent and a source of nebulizing gas.

3. The liquid sample ionizer of claim 1, wherein the fluid conduit includes a tube configured to deliver the liquid sample to the sample stage.

4. The liquid sample ionizer of claim 1, wherein the sample stage is comprised of polytetrafluoroethylene.

5. The liquid sample ionizer of claim 3, wherein the tube is comprised of silica, stainless steel, aluminum, or a combination thereof.

6. The liquid sample ionizer of claim 3, wherein the tube includes an inner diameter ranging from approximately 0.1 mm to approximately 0.3 mm.

7. The liquid sample ionizer of claim 3, further comprising a continuous-flow pump configured to continuously pump the liquid sample through the tube to the sample stage at a rate of approximately 0.1 μL/min to approximately 10 μL/min.

8. The liquid sample ionizer of claim 7, wherein the rate is approximately 0.1 μL/min to approximately 5 μL/min.

9. The liquid sample ionizer of claim 3, wherein the outlet of the nebulizing ionizer and the outlet of the tube are horizontally separated by approximately 0.5 mm.

10. The liquid sample ionizer of claim 1, wherein a spray impact angle, θ, between the nebulizing ionizer and the sample stage is approximately 30° to approximately 45°.

11. A mass spectrometer comprising:

a fluid conduit configured to continuously supply a liquid sample for ionization and analysis by the mass spectrometer;

an ion source comprising a sample stage configured to receive the liquid sample and a nebulizing ionizer configured to generate a charged, nebulized solvent, wherein the charged, nebulized solvent desorbs at least a portion of the liquid sample from the sample stage;

a mass analyzer configured to receive the desorbed portion of the liquid sample, to ionize the desorbed portion of the liquid sample, and to analyze a mass-to-charge ratio of the ionized, desorbed portion of the liquid sample; and a controller configured to operate the ion source, the mass analyzer, or a combination thereof.

12. The mass spectrometer of claim 11 further comprising a curtain plate configured to separate the ion source and the mass analyzer.

13. The mass spectrometer of claim 11, wherein the fluid conduit includes a tube configured to deliver the liquid sample to the sample stage.

14. The mass spectrometer of claim 13, wherein an outlet of the tube and an aperture of the curtain plate are separated from approximately 1 mm to approximately 2 mm apart.

15. A method of ionizing a liquid sample for mass spectroscopy analysis comprising:

generating a charged, nebulized solvent;

continuously supplying a liquid sample;

directing the charged, nebulized solvent to the liquid sample thereby desorbing at least a portion of the liquid sample;

ionizing the desorbed portion of the liquid sample; and directing the ionized, desorbed portion of the liquid sample to a mass analyzer.

16. The method of claim 15 further comprising:

removing an ionized solvent from the desorbed, ionized portion of the liquid sample.

17. The method of claim 15, wherein the step of directing the charged, nebulized solvent is at a spray impact angle, θ, with respect to a surface of the sample.

18. The method of claim 15 wherein the charged, nebulized solvent comprises methanol, acetic acid, or water, or a combination thereof.

19. The method of claim 18 wherein the charged, nebulized solvent further comprises a reactant.

20. The method of claim 19 wherein the reactant is a zinc complex.

21. A method of analyzing a liquid sample comprising:

continuously introducing a liquid sample to a sample stage;

generating a charged, nebulized solvent;

directing the charged, nebulized solvent to the liquid sample on the sample stage, wherein the charged, nebulized solvent desorbs at least a portion of the liquid sample from the sample stage and directs the desorbed portion of the liquid sample in a direction substantially toward a mass analyzer;

ionizing the desorbed portion of the liquid sample;

separating an ionized solvent from the ionized, desorbed portion of the ionized liquid sample; and analyzing a mass-to-charge ratio of the desorbed portion of the ionized sample.

22. The method of claim 21, wherein the method further includes removing at least a portion of the liquid sample by chromatography before continuously supplying the liquid sample.

23. The method of claim 21, wherein the method further includes removing at least a portion of the liquid sample by electrophoresis.

24. The method of claim 21, wherein the method further includes removing at least a portion of the liquid sample by microfluidics.

* * * * *

UNITED STATES PATENT AND TRADEMARK OFFICE

CERTIFICATE OF CORRECTION

PATENT NO. : 7,915,579 B2
APPLICATION NO. : 12/205236
DATED : March 29, 2011
INVENTOR(S) : Hao Chen et al.

It is certified that error appears in the above-identified patent and that said Letters Patent is hereby corrected as shown below:

Title page item [54]

In the title, "SPECROMETRY" should be --SPECTROMETRY--.

Column 1

In the title, "SPECROMETRY" should be --SPECTROMETRY--.

Column 2

Line 25, "a charged" should be --charged--.

Column 4

Line 47, "desorbs" should be --desorb--.

Column 5

Line 63, "electrode" should be --electrodes--.

Column 6

Line 40, "affects" should be --effects--.

Column 7

Line 21, delete "which".

Signed and Sealed this
Fifth Day of July, 2011

David J. Kappos

David J. Kappos
*Director of the United States Patent and Trademark Office*